US008096785B2

(12) United States Patent
Eysymontt

(10) Patent No.: US 8,096,785 B2
(45) Date of Patent: Jan. 17, 2012

(54) HYDRAULICALLY DRIVEN MULTICYLINDER PUMPING MACHINE

(75) Inventor: Jan Eysymontt, Nyon (CH)

(73) Assignee: Garniman S.A., Montevideo (UY)

( * ) Notice: Subject to any disclaimer, the term of this patent is extended or adjusted under 35 U.S.C. 154(b) by 1015 days.

(21) Appl. No.: 11/569,727

(22) PCT Filed: Jun. 2, 2005

(86) PCT No.: PCT/IB2005/001890

§ 371 (c)(1),
(2), (4) Date: Nov. 28, 2006

(87) PCT Pub. No.: WO2005/119063

PCT Pub. Date: Dec. 15, 2005

(65) Prior Publication Data

US 2008/0226466 A1 Sep. 18, 2008

(30) Foreign Application Priority Data

Jun. 2, 2004 (EP) ..... 04405335

(51) Int. Cl.
*F04B 45/00* (2006.01)
*F04B 43/06* (2006.01)

(52) U.S. Cl. ..... 417/395; 417/53; 417/413.1

(58) Field of Classification Search ..... 417/472, 417/473, 395, 53; 92/37, 38, 43
See application file for complete search history.

(56) References Cited

U.S. PATENT DOCUMENTS 1,580,479 A * 4/1926 Frankenfield ..... 417/244
2,464,095 A * 3/1949 Nies ..... 417/375
2,468,489 A * 4/1949 D Arcey ..... 60/572
2,613,607 A * 10/1952 Sheen et al. ..... 417/388
2,613,610 A * 10/1952 Saalfrank ..... 417/313
2,951,450 A * 9/1960 Fisher ..... 417/273
3,099,222 A * 7/1963 Poliseo ..... 417/379
3,182,597 A * 5/1965 Malizard et al. ..... 417/339
3,192,860 A * 7/1965 Hardison ..... 417/390
4,488,592 A * 12/1984 Mittal et al. ..... 165/104.31
4,634,430 A * 1/1987 Polaschegg ..... 604/141
4,902,206 A * 2/1990 Nakazawa et al. ..... 417/394
5,108,426 A * 4/1992 Biro et al. ..... 623/3.17
5,141,412 A * 8/1992 Meinz ..... 417/473

(Continued)

FOREIGN PATENT DOCUMENTS

DE 1653445 7/1971

(Continued)

*Primary Examiner* — Devon C Kramer
*Assistant Examiner* — Amene Bayou
(74) *Attorney, Agent, or Firm* — Sturm & Fix LLP

(57) ABSTRACT

A hydraulically driven multicylinder diaphragm pumping machine has pump cylinders, each having at one end an inlet/outlet for fluid material to be pumped, and at the other end an inlet and outlet for hydraulic oil. A separator inside the pump cylinder is connected to the fluid-material end of the cylinder by a flexible diaphragm and to the fluid material end by another diaphragm, leaving an outer annular space that contains hydraulic fluid. The total volume of pumping hydraulic oil in the cylinders is maintained constant and by a device that compensates for thermal expansion and controls the necessary return flow of hydraulic oil for driving the pump. The separators move with an intake stroke at constant speed for all cylinders, and with pumping strokes function of the hydraulic oil delivery, so a lesser number of separators effect an intake stroke while a greater number of separators effect a discharge stroke.

20 Claims, 3 Drawing Sheets

U.S. PATENT DOCUMENTS 5,195,878 A * 3/1993 Sahiavo et al. ..... 417/393
5,308,230 A * 5/1994 Moore ..... 417/394
5,375,430 A * 12/1994 Siegel ..... 62/259.3
5,558,506 A * 9/1996 Simmons et al. ..... 417/393
5,634,779 A * 6/1997 Eysymontt ..... 417/342
6,071,094 A * 6/2000 Yu et al. ..... 417/441
6,345,963 B1 * 2/2002 Thomin et al. ..... 417/412
6,814,553 B2 * 11/2004 Watanabe et al. ..... 417/473
6,874,997 B2 * 4/2005 Watanabe et al. ..... 417/395
6,905,314 B2 * 6/2005 Danby ..... 417/53

FOREIGN PATENT DOCUMENTS

FR 1315900 1/1963
JP 60008485 1/1985

* cited by examiner

HYDRAULICALLY DRIVEN MULTICYLINDER PUMPING MACHINE

FIELD OF THE INVENTION

The invention relates to hydraulically driven multicylinder diaphragm pumping machines, in particular for pumping difficult-to-pump fluid materials, like minerals, ores, sludges, suspensions, slurries, and gels, and to methods of operating such pumping machines. These pumping machines may be referred to herein simply as pumps or machines.

BACKGROUND OF THE INVENTION

Conventional pumping machines that can be used for difficult-to-pump materials have displacement organs such as pistons, plungers, peristaltic hoses etc. However such displacement organs are subject to frictional wear and the drive of the machine is not properly isolated from the pumped material.

Pumps with flat or tubular diaphragms are known. A pump of the flat membrane type is commercialized by Geho. The tubular diaphragm pump is described as an improvement over the flat membrane type. One example of a tubular diaphragm pump is described in patent specification GB 2161221. This pump uses a flexible hose as diaphragm that is set in motion by an actuation fluid by means of a reciprocating piston, so that the diaphragm makes a movement comparable to a pulsating human vein. Hose diaphragm piston pumps are commercialized by Feluwa.

However the membranes of these known membrane pumps are driven by a crankshaft mechanism which especially in large machines is heavy and costly and requires pulsation dampening.

FR-A-315,900, Patent Abstracts of Japan 60008485, U.S. Pat. No. 2,464,095 and DE-A-1653445 all describe pumps in which pumped fluid and a pumping fluid are separated by a bellows-like diaphragm. However, none of the cited pump diaphragm systems possesses the advantage of a double protection of the pumped fluid from the pumping fluid, and none are adapted for multicylinder arrangements.

SUMMARY OF THE INVENTION

The invention provides a hydraulically driven multicylinder diaphragm pumping machine, in particular for pumping difficult-to-pump materials. The pumping machine comprises a plurality of pump cylinders each having one end with an inlet and outlet for fluid to be pumped and another end with an inlet and outlet for hydraulic fluid. These inlets and outlets can be a separate inlet and outlet (for the hydraulic fluid) or a combined inlet/outlet (for the fluid material being pumped). The inlets and outlets are associated with respective inlet and outlet valves. A separator is located inside and is movable to-and-fro along each pump cylinder. The movable separator has one side facing the pumped-material end of the cylinder and another side facing the hydraulic-fluid end of the cylinder. This movable separator is connected to the inside of the pumped-material end of the cylinder by a first flexible diaphragm (referred to below also as the "fluid material diaphragm") in the form of a concertina-like bellows that is expandable and contractable inside the cylinder along the length direction of the cylinder as the movable separator moves to-and-fro along the cylinder. The movable separator delimits a first chamber inside the first bellows-like flexible diaphragm for containing a variable volume of pumped fluid in communication via the inlet and outlet with a pumped fluid manifold and circuit. The movable separator is connected also to the inside of the second end of the cylinder by a second flexible diaphragm in the form of a concertina-like bellows that is contractable and expandible along the length direction of the cylinder in correspondence with expansion and contraction of the first flexible diaphragm. The second side of the movable separator delimits a second chamber inside the second expandable and contractable diaphragm for containing a variable volume of hydraulic fluid in communication with the second inlet and outlet. An annular space is defined between the outside of the first and second diaphragms and the inner wall of the pump cylinder which annular space in use contains a fluid that is the same as said hydraulic fluid or has similar hydraulic characteristics.

The new pumping machine is directly driven by a hydraulic pump drive, greatly simplifying the machine and providing simple means of variation and control of the flow of the pumped fluid delivered. Moreover, the double diaphragm arrangement provides a double protection of the pumped fluid from the pumping fluid.

The invention also relates to methods of operating and starting the pumping machine. In the operative state of the hydraulically driven multicylinder pumping machine according to the invention, the fluid-material inlets and outlets communicate the first chambers with a fluid to be pumped, and the hydraulic-fluid inlets and outlets communicate the hydraulic fluid chambers with a hydraulic circuit. The method comprises driving the movable separator of some cylinders with an intake (return) stroke along the direction from the fluid material intake/outlet end towards the hydraulic fluid end of the cylinder, to intake into the first chambers material (pressurized by external means), and simultaneously discharge hydraulic fluid from the corresponding second chambers, while driving the movable separators of other cylinders with a pumping stroke along the direction from the hydraulic-fluid end towards the fluid material end of the cylinder by intaking pressurized hydraulic fluid into the corresponding chambers and discharging pumped materials. During operation, the sum of the volumes of hydraulic fluid in the pumping chambers is maintained substantially constant and substantially equal to ½ the total displacement volume of the cylinders defined as the total volume of hydraulic fluid that is displaceable in each cylinder for the full to-and-fro stroke of each movable separator member, multiplied by the number of cylinders.

The movable separators move all with an intake stroke at constant (but adjustable) speed for all intaking cylinders, and with pumping strokes all with substantially the same speed which is variable and adjustable proportionally to the volume of driving hydraulic fluid.

The minimum return speed must be at least equal to the speed of the forward stroke when it is at its maximum value, with at least one movable separator effecting an intake (return) stroke at a relatively high speed while a greater number of separators are effecting a discharge stroke at relatively slow speed. The slower the speed of the pumping stroke (the lower the delivery of the volume delivered by the hydraulic pumps) the less the numbers of separators that at the same time perform the intake/return stroke.

Further aspects and advantages of the invention are set out in the detailed description and particular features of the invention are set out in the claims.

BRIEF DESCRIPTION OF THE DRAWINGS

The accompanying schematic drawings, given by way of example, show embodiments of the hydraulically driven multicylinder pumping machine according to the invention. In the drawings.

DETAILED DESCRIPTION

Figure 1:
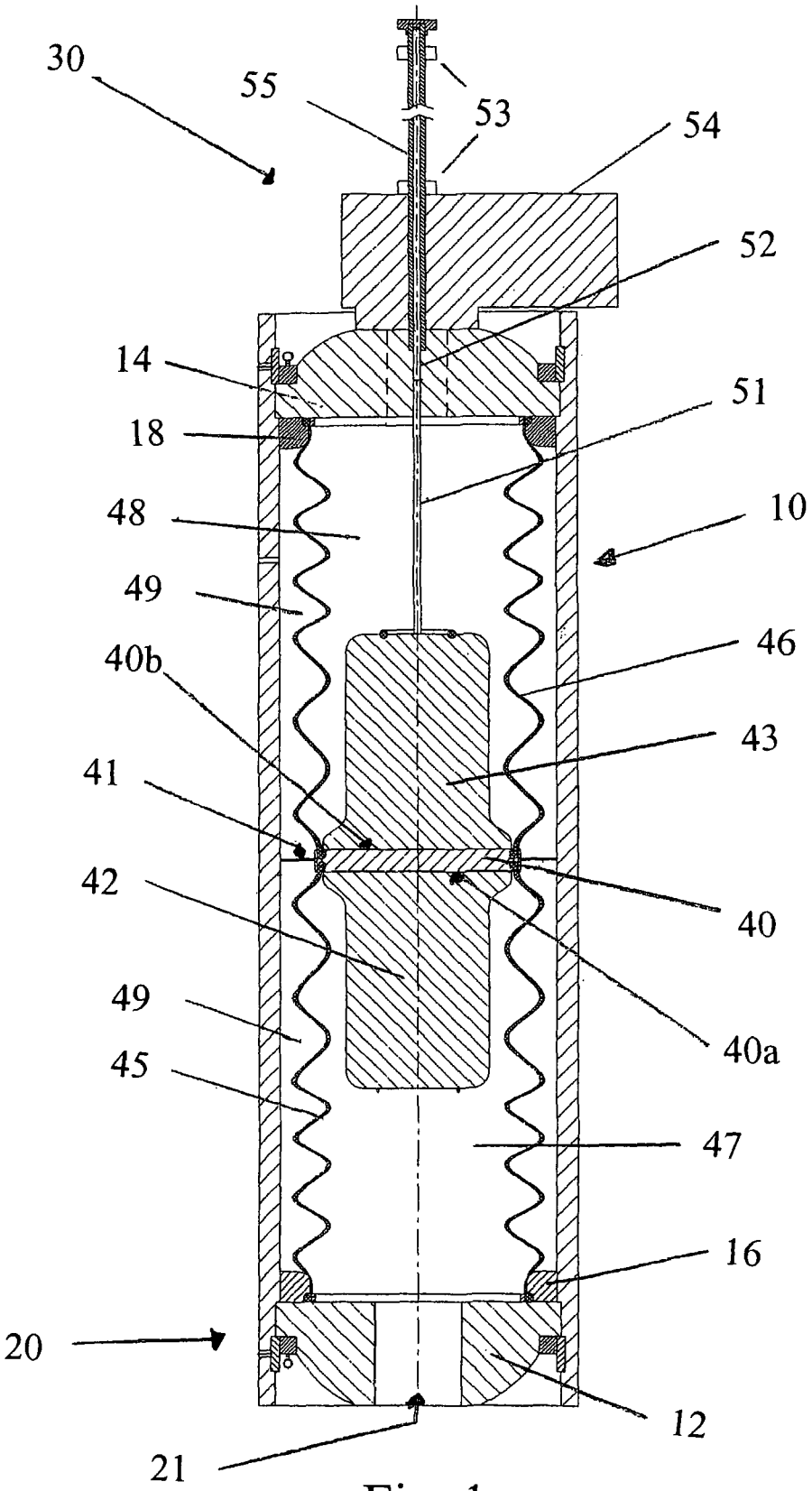
FIG. 1 is a cross-sectional view of one embodiment of a pump cylinder of a pumping machine according to the invention.
Figure 2:
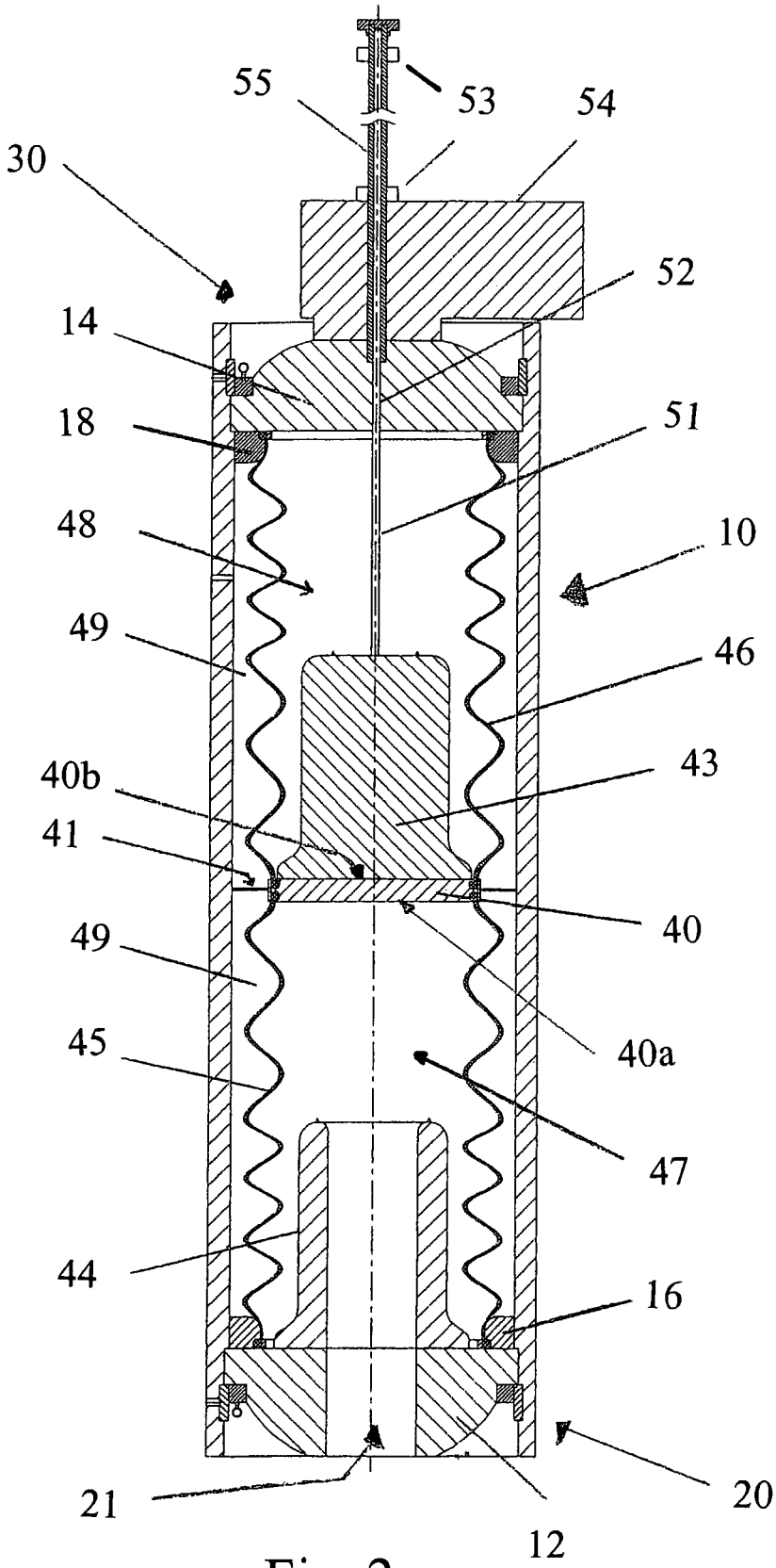
FIG. 2 is a cross sectional view of another embodiment of a pump cylinder of a pumping machine according to the invention.
Figure 3:
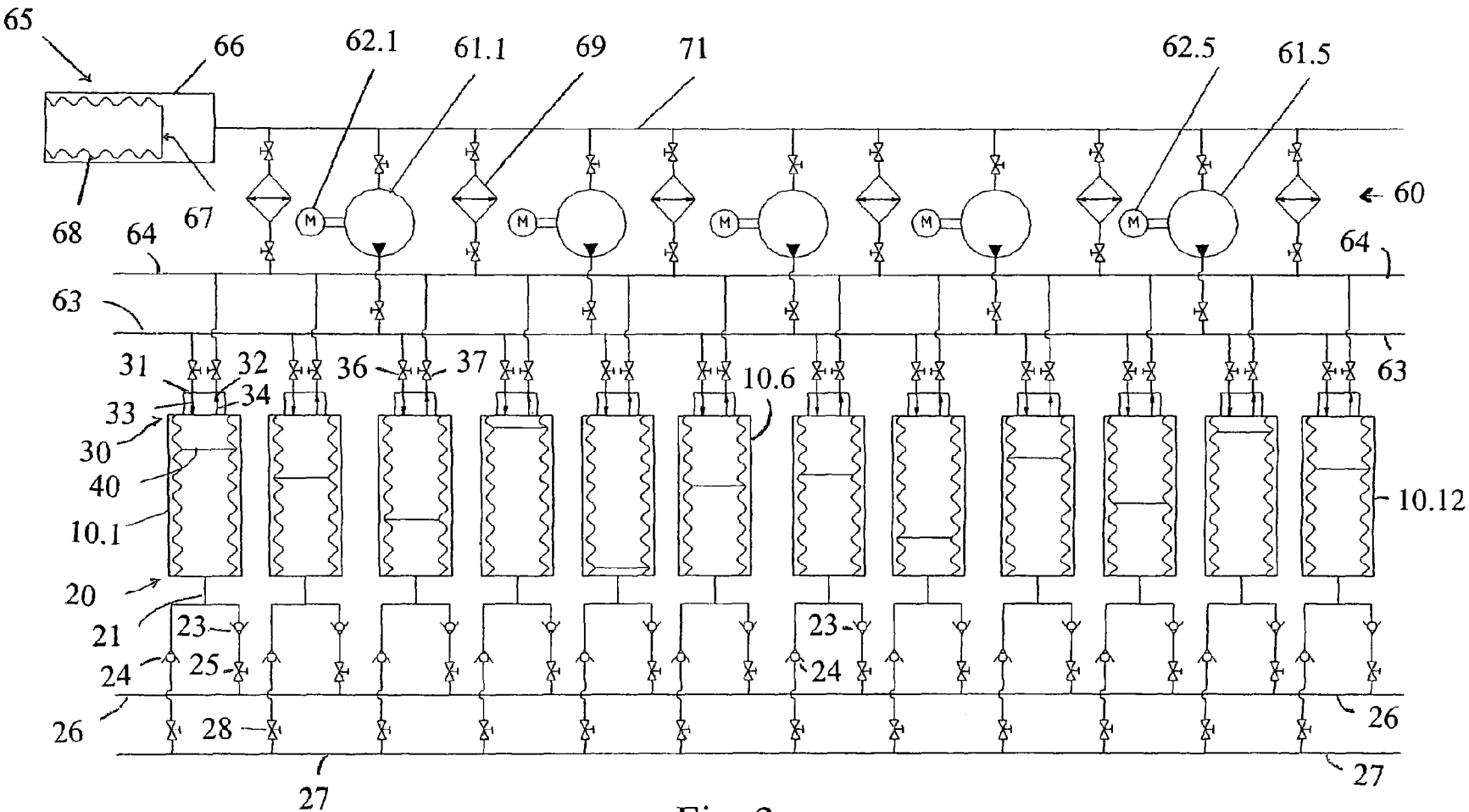
FIG. 3 is an overall diagram of the multicylinder pumping machine according to the invention.

The pumping machine whose layout is illustrated in FIG. 3 is composed in this example of twelve pressure resistant steel cylinders 10.1-10.12 containing each a non-conventional double membrane displacement device shown in detail in FIG. 1 and in a varied form in FIG. 2. All the cylinders 10.1-10.12 work in parallel and their forward (pumping) stroke is driven by hydraulic oil under pressure coming via a hydraulic circuit 60 from one or more hydraulic pumps 61.1-61.5, five such hydraulic pumps being shown, each powered by an electric motor 62.1-62.5, and connected in parallel with heat exchangers 69 for cooling the hydraulic oil. The hydraulic circuit 60 includes oil intake and outlet manifolds 63,64 and a pump's cooled oil manifold 71.

The pump cylinders 10 each have a first or bottom end 20 with a combined first inlet and outlet 21 for fluid to be pumped and a second or upper end 30 with a second inlet 31 and a separate second outlet 32 for hydraulic oil. The inlet/outlet 21 for pumped material branches into inlet and outlet conduits fitted respectively with an inlet valve 23 and a an outlet valve 24. The inlet 31 for hydraulic oil is fitted with an inlet valve 33 and outlet 32 with an outlet valve 34. The hydraulic oil valves 33,34 are incorporated in a valve block 54.

The cylinder's bottom and top ends 20,30 are closed respectively by a bottom cover 12 and a top cover 14 that in this example are fixed inside the cylinder, and are equipped with rings 16,18 for securing the ends of the membranes 45,46. The top cover 14 and valve block 54 have bores (out of the plane of FIGS. 1 and 2) forming the oil inlets/outlets 31/32, A disc-like movable separator 40 is located inside each pump cylinder 10 and is movable to-and-fro along the pump cylinder. The movable separator 40 has a first side 40*a*, in this example carrying a spacer 42, facing the cylinder's first end 20, and a second side 40*b*, in this example carrying a spacer 43, facing the cylinder's second end 30. This movable separator 40 is connected to the inside of the cylinder's first end 20 by a flexible diaphragm 45 (referred to later as the "first flexible diaphragm") in the form of a concertina-like bellows that is expandable and contractable inside the cylinder 10 along the length direction of the cylinder as the movable separator 40 moves to-and-fro along the cylinder.

The movable separator's first side 40*a* with its spacer 42 delimits, inside the expandable and contractable flexible diaphragm 45, a first chamber 47 containing a variable volume of pumped fluid in communication with the first inlet/outlet 21. The separator's second side 40*b* with its spacer 43 delimits a second chamber 48 containing a variable volume of hydraulic oil in communication with the second inlet and outlet 31/32. As shown in FIGS. 1 and 2, the movable separator 40 is connected to the inside of the cylinder's top end 30 by a second flexible diaphragm 46 in the form of a concertina-like bellows that is contractable and expandable along the length direction of cylinder 10 in correspondence with expansion and contraction of the first flexible diaphragm 45. An annular space 49 is defined between the outside of the first and second diaphragms 45,46 and the inner wall of pump cylinder 10. This annular space 49 contains a hydraulic fluid that is the same as the oil in chamber 48 or has similar hydraulic characteristics.

A perforated guide ring 41 or projecting centrators around the periphery of separator 40 and which lightly contacts the cylinder's inside surface, guides the separator 40 as it moves along the cylinder 10, the ring 41 having openings allowing for the free passage of the hydraulic fluid between the upper and lower parts of the annular space 49.

The spacers 42,43 are typically made of lightweight material and are sufficiently long so that they permit the use of long cylinders 10 while limiting the maximum possible stroke length of the separators 40 to a suitable value, thus reducing stress on the bellow-like membranes 45,46.

A sensor (not shown) is provided for detecting foreign matter in the hydraulic fluid in annular space 49. Such sensor will detect the presence, in the hydraulic fluid contained in annular space 49, of matter from the material being pumped that penetrates the membrane 45 in case of rupture, and signal the need for servicing.

The inlet 21 is connected via a pumped material inlet manifold 26 and outlet manifold 27. These manifolds and their associated circuitry include shut-off valves 28 which (in conjunction with shut-off valves 36,37 in the hydraulic oil circuit 60) enable the individual cylinders 10 to be taken out of circuit and removed for servicing. The inlet manifold 26 is connected to external means (not shown) for supplying the material to be pumped under an adjustable pressure sufficient to drive the separator 40 in an intake (return) stroke along the direction from the first end 20 towards the second end 30 of cylinder 10. Said means is preferably arranged to supply the material to be pumped under pneumatic pressure.

FIGS. 1 and 2 show two different possible means for limiting the length of the stroke of the to-and-fro movement of the movable separator 40 along each cylinder 10. In FIG. 1 these stroke-limiting means comprise two spacers 42,43 carried by and protruding from the first and second sides 40*a*,40*b* of the movable separator 40, and which can come to abut against the inside of end covers 12,14 at the first or second end 20,30 of cylinder 10. In FIG. 2, the separator's lower spacer 42 is replaced by an upstanding spacer tube 44 on the cylinder's lower end 20. FIG. 2's arrangement may be used when the pumped material does not contain residues that could accumulate in the space surrounding the spacer tube 44 and inside the bottom part of the bellows-like membrane 45. FIG. 1's arrangement will be preferred for more difficult-to-pump materials that are liable to produce such residues.

These spacers, 42,43,44 set the maximum displacement of the movable separators 40, but are not intended to act as stroke-limiting abutments during the normal to-and-fro motion. Instead, the stroke length is controlled by detecting the position of the movable separator 40 along each cylinder 10, and controlling the opening and closing of the inlet and outlet valves 23,24;33,34 so as to produce to-and-fro movement of the movable separators 40 with a controlled stroke length.

As shown for example in FIGS. 1 and 2, the position detecting means comprises a rod 51 fixed in the spacer 43 on the separator 40 for to-and-fro movement therewith. This rod 51 protrudes up from spacer 43 and slidably extends through a bore 52 in the top cover 14 and valve block 54, and through a vertically protruding tube 55. A number of position detectors for instance Hall-effect sensors 53 are fitted on the tube 55 above block 54 for detecting the position of rod 51. Two sensors 53 are shown, but numerous double and intermediate sensors would normally be used. Alternatively, continuously-working position sensors can be used.

The pumping machine is also provided with means (not shown) for metering the flow of hydraulic oil leaving the pump cylinders 10 via outlets 32. Similar means can be provided for metering the outlet of pumped material via outlet 21.

The position detecting means 51,53 and the flow metering means are advantageously associated with an electronic controller including a display for showing the positions and the directions of movement of the movable members 40 in pump cylinders 10. This enables the operator to ascertain instantaneously the machine's operative condition.

The pumping machine contains variable volumes of hydraulic oil in the second chambers 48 of pump cylinders 10.1-10.12 which are connected via the second inlets 31 and outlets 32 to the external hydraulic circuit 60. The machine contains a given volume of hydraulic oil equal to the sum of the volume of hydraulic oil in the hydraulic circuit 60 outside the cylinders 10, plus the sum of the volumes of hydraulic oil in all the chambers 48 and hence inside all the cylinders 10.1-10.12. The volume of hydraulic oil in each individual cylinder 10 varies with the to-and-fro movements of its separator 40, while the sum of the volumes of hydraulic oil in all the chambers 48 remains substantially constant and remains substantially equal to ½ the total displacement volume of the cylinders 10.1-10.12, defined as the total volume of hydraulic oil that is displaceable in each cylinder 10 for the full to-and-fro stroke of each movable member 40 controlled as explained above, multiplied by the number of cylinders.

The total mass of the hydraulic oil in the hydraulic circuit including that in circuit 60 and that in the chambers 48 of all the cylinders 10.1-10.12 is constant; the volume varies according to temperature.

A device 65 is provided for adjusting the volume of the driving hydraulic oil in the machine, to compensate for thermal expansion of the oil. This device 65 is arranged to maintain the volume of oil in the pump cylinders 10.1-10.1 substantially constant and always substantially equal to ½ the total displacement volume of the cylinders. As shown in FIG. 3, this compensating device 65 comprises a hydraulic oil cylinder 66 containing a variable volume of hydraulic oil determined by a movable member 67 applying pneumatic pressure to the oil by means of a bellows-like membrane 68. Cylinder 66 is shown horizontal, but will normally be vertical with its hydraulic oil at a variable level.

The control involves: the level monitoring of the device 65; temperature monitoring; and level control to account for changes of temperature. Monitoring the level in device 65 then enables verification of the maintenance of the previously-mentioned conditions in order to maintain the said constant total volume of hydraulic oil in the cylinders.

The described hydraulically driven multicylinder diaphragm pumping machine is arranged such that in operation the movable separators 40 move with an upward intake (return) stroke at constant but adjustable speed for all cylinders 10.1-10.12, and with a downward pumping stroke at speeds that are a function of the delivery of hydraulic oil by the driving pumps 61.1-61.5.

The machine is moreover arranged such that at least one movable separator 40 is effecting an intake (return) stroke at a relatively high speed while a greater number of movable members 40 are effecting a discharge stroke at relatively slow but adjustable speed essentially equal for all discharging cylinders. For example with a twelve-cylinder pump as shown, typically four movable separators 40 are effecting the intake stroke, while eight are effecting the discharge stroke; however, this ratio will depend mainly, among other factors, on the amount of oil being discharged by the oil pumps.

The described pumping machine can be started up by filling the pump cylinders chambers 48 with different volumes of hydraulic oil (as described in detail below) so that the pump cylinders 10.1-10.12 contain in total a volume of hydraulic oil equal to ½ the total displacement volume of all the cylinders 10.1-10.12; and placing the movable members 40 in to-and-fro motion while maintaining the same total volume of hydraulic fluid in the cylinders 10.1-10.12.

The return (intake) stroke is accomplished by the pumped material being supplied to the pumped material intake manifold 26 under pressure provided by any suitable means from outside the machine. As mentioned above, a convenient way of pressurizing the pumped material is pneumatic, and this can be achieved using two parallel cylindrical containers designed for interior pressure equivalent to the pressure at which the pumped material is to be fed to the machine, closed at their tops, connected by simple inlet valves with a tank of the material to be pumped and similar outlet valves at the bottom or in their lower part. These tanks are connected to the outlet manifold 27 and equipped with a system of upper and lower level signalisations that in turn activate a compressed air valve that lets the air into the container that is full, to expel its contents into the machine's intake manifold 26. Dual tanks containing the material to be pumped can be arranged for alternate operation, so that while one is being emptied the other is being filled with the material, letting the air out from the other (emptied) container in order to allow it to be filled by the material.

The pressure under which the material is to be fed to the pump must be variable and must overcome the pressure losses caused by: its passage through the intake valve 23, the compressive deformation of the lower (material) diaphragm 45 and the extension of the upper (oil) diaphragm 46; the passage of the hydraulic oil from the upper diaphragm chamber 48 through the outlet valve 34 in the hydraulic valve's block 54, and through the flow meter located in the block 54 into an upper (hot oil) return oil collector manifold 64, through heat exchangers 69 (that cool the oil) and through the lower (cooled oil) return collector manifold 71 back to the oil pump(s) 61.1-61.5. The resulting needed pressure for supplying the material to be pumped is calibrated, experimentally established and must be sufficient to provide the return of the oil during the backward stroke at the same rate as the forward flow at the maximum delivery of the oil pump(s) 61.1-61.5 (the total quantity of oil returning equals that of oil leaving the oil pump(s)) and must be at least sufficient to provide the necessary return of the oil.

Every cylinder 10 has attached to its upper cover 14 a valve block 54 containing the inlet and outlet valves 33,34 for the oil actuated by electric pilot valves, also part of the valve block 54. The pilot valves obtain signals to open and close from the proximity sensors 53 located at the top of valve block 54 (see FIGS. 1 and 2). These signals are communicated to a central electronic controller of the machine which among other functions also disposes of a counter of signals given by the proximity sensor system 53. Every signal for a pilot valve to open to let the pressurized oil enter the upper diaphragm chamber 48 and start the forward stroke in the pressure cylinder 10 is registered and exhibited on the aforementioned display in the corresponding sequence. So it is known at any time which separator 40 (of those simultaneously actuating at that moment) has started its forward stroke first. Should ever the equilibrium between the flow of oil leaving the cylinder(s) 10.1-10.12 and the return flow become altered (condition: return flow less than the pressure flow), the disequilibrium is easily and momentaneously corrected by reversing the position of the oil valves in the corresponding cylinder 10. The separator 40 will start returning (before coming to the normal end of stroke), its oil increasing the quantity of oil returning to the cylinders 10.1-10.21.

The total quantity of oil in the hydraulic circuit 60 is controlled automatically by the electronic controller in response to a signal coming to the controller from the oil level sensor system 65 that monitors the level of oil in a, normally tubular in form, oil reservoir 66 situated at the end of the return oil manifold 71 (cooled oil manifold which feeds the pumps, see FIG. 3). The level sensor system 65 takes account of the thermal expansion and contraction of all the oil contained in the machine.

The pressure applied to the material to be pumped in order to feed it to the machine and obtain the return stroke of the diaphragm/separator 45/40 is established according to all the conditions prevailing, that is the density, viscosity and other rheological characteristics of the material on the one hand, and on the other from the available and/or convenient-to-apply means to exert this pressure, and also keeping in mind that the flow of the returning oil must be equal to the flow of oil from the oil pump(s) 61.1-61.5. This pressure must be adjustable.

The previously-mentioned proximity sensor system 51/53 that provides signals of beginning and end of stroke to the electronic controller of the machine is also fitted with a number of intermediate sensors 53 of the same or similar type that allow the controller to establish at all times the position of the diaphragm/separator 45/40 on its way up or down and display it on the monitoring electronic display of the control of the machine. An additional means of obtaining information on the position of the diaphragm is given by signals provided by the previously-mentioned flow meter located in the valve block 54 of each cylinder 10 and connected with the microprocessor controller.

Such mode of operation of the machine results in varying speed of the forward stroke depending on the delivery of the hydraulic pump(s), the speed of the return stroke remaining constant. The number of forward stroking diaphragms/separators 45/40 in relation to that of diaphragms returning at the same moment varies. It is desirable to maximally reduce the speed of the forward stroke (for any given production of the machine) and this can be obtained by increasing the speed of the return stroke (by raising the feed pressure of the material).

The total internal volume available for the hydraulic oil within the machine is exactly calculated. The machine is first filled with hydraulic oil and operated without pressure in a closed circuit using some substitute liquid (normally water) instead of the material to be pumped. During that operation all the hydraulic oil is recirculated through a commercially-available external device in which the oil is degassed and optionally also microfiltered (down to 1μ particles). Now the oil (degassed, and microfiltered) is filling the oil part (drive part) of the machine completely, except for the interior chambers 48 of the oil membranes 46 which are partly filled in such a way that the first (chamber 48 of cylinder 10.1) is filled full stroke and the last (chamber 48 of cylinder 10.12) shall be completely contracted (return stroke end position). All the intermediate diaphragm chambers 48 are filled each with proportionally less oil. So, the chamber 48 of the first cylinder is filled $^{12}/_{12}$ths, that of the second cylinder $^{11}/_{12}$ths, that of the third cylinder $^{10}/_{12}$ths, and so on. Thus the total quantity of oil filling the diaphragm chambers 48 will be equal to half of the sum of their stroke volumes. This is done by pressure dosifying liquid (water for instance) from the feeding system (material to be pumped feeding system) combined with manipulation of oil valves of the cylinders. The oil reservoir 66 is filled to the level calculated, accordingly to the oil's and the machine's temperature at that moment and the reservoir 66 is closed and the oil level monitoring system 65 set. The system 65's reservoir is fitted at its upper end with an elastomeric bellows cap 66 and a hermetic cover. The volume between the cover and the bottom of the extensible bellows cap 67 is connected via a pressure regulating valve with a source of compressed air. The air pressure acting through the bellows 68 on the oil contained in the reservoir 66 is kept equal to the pressure of oil measured in the pump's oil intake manifold 71 and can be lowered or raised, correspondingly to the returning oil pressure (which can be changed by varying pressure of air in the previously-described pneumatic material feeding containers). The reservoir 66 acts as a compensator for the oil's thermal volume expansion and permits to detect an abnormal situation of the passing of oil to the pumps' intake manifold 71 from the reservoir 66 (return flow of oil less than pumps' output).

An additional monitoring system for the correct regular functioning of the machine (without hydraulic hammers) consists of flow meters installed at each oil outlet 32 of each cylinder 10 which communicate the measured values to the electronic controller of the machine. The sum of the metered flow values is compared to the output of the oil pumps 61.1-61.5 and, should a difference appear, this is corrected by the already-explained intervention of the controller through oil valve reversal and/or the pressure of the product fed to the intake of the machine is raised thereby increasing the amount of oil return. The flow meters also allow the instant detection and correction of any unusual behaviour of any individual membrane/separator 45/40 during its return stroke.

In a typical embodiment, the pump has from eight to sixteen, usually from ten to twelve cylinders 10 with a length of up to 2 meters, usually 1.5 meters or 1 meter. For most applications cylinder diameters will be typically from 200 to 400 mm. The displacement volume of the pump's cylinders 10 can typically for example be from 15 to 30 litres per stroke. Smaller pumps can be made, but larger pumps are especially advantageous.

This pump has many advantages over prior hydraulically-operated pumps for pumping difficult-to-pump fluids. The use of diaphragms 45/46 instead of other displacement organs such as pistons, plungers, peristaltic hoses etc. is already in principle, an enormous advantage over pumps with such organs because it allows to eliminate frictional wear and permits isolation of the drive of the machine from the pumped material.

The bellows-type diaphragm 45, in particular a double bellows-type diaphragm 45/46, in comparison with flat or tubular diaphragms, such as employed in the above-mentioned diaphragm slurry pumps made by GEHO and FELUWA for example, permits to dramatically reduce the mechanical stresses in the diaphragm's material due to the total length of the bellows employed as diaphragm in relation to the stroke length (a ratio of 2:1 or more). The concept of the two equal bellows 45/46 forming an external annular protection and isolation chambers solves several problems:

1) Double separation: no contact of the driving oil with the pumped material in case of puncture or other failure of the product diaphragm 45.
2) Instant signalisation of such circumstance thanks to the possibility to place the aforementioned chemical sensor in the annular oil chamber 49, for sensing foreign bodies in the hydraulic fluid in case of puncture or failure of diaphragm 45.
3) Possibility of using different materials for each diaphragm 45,46.

4) Elimination of dead volume by partly filling the chambers 47,48 with lightweight material shapes/spacers 42,43, submitted to pressure from all sides, thus not affected by pressure.

5) Elimination of damage due to abnormal down stroke movement beyond the length of stroke by point-form limiters 44 extending from said dead volume, or filling shapes/spacers 42,43, conserving the condition of liquid pressure surrounding the shapes 42,43. At the same time, damage to the upper diaphragm 46 in case of moving too far up can be eliminated by a seal around the main oil entrance. An additional oil entrance fitted with a non-return valve situated outside of the main oil entrance avoids raise of oil pressure that otherwise would result when starting the pumping stroke.

6) The diaphragms 45,46 are permanently centred (guided along their axis) during their stroke.

Additionally the machine exhibits the following important advantages:

a) The absence of a crankshaft mechanism drive, gear or other reducer and the inevitable frequency regulation of the electric motors 61 in order to be able to regulate and variate the flow.

b) Pulsation-free flow without the use of any dampeners.

c) Extremely slow stroking (5-10/min) meaning drastic reduction of fatigue of the diaphragms 45,46 and wear of the valves.

d) Modular construction such to allow removal or repair of all the components of the machine, except the collectors/manifolds, without stopping the machine, by taking individual cylinders 10 out of circuit.

e) In cases where reserve machines would normally be required, it suffices to provide one additional drive unit (motor/hydraulic pump) which permits to eliminate the necessity of an additional stand-by machine.

f) Because of its modular construction, removing or adding modules enables the overall size of the machine to be changed for different applications.

g) Very large machines can be constructed by assembling a limited number of each small components. No known pump can be built this way.

Many modifications can be made to the described embodiments of the pump and method according to the invention without departing from the scope of the attached claims. The design of the metallic part of the cylinders 10 with its covers can be varied according to requirements. The ratio of the power pressure to the pumping pressure in normally 1:1, but it can be varied by replacing the head 14 with a hydraulic multiplying stage. The pump cylinders 10 are usually more-or-less upright and can be disposed in-line or in any convenient configuration such as generally rectangular or circular.

The described pump is particularly suitable for pumping difficult-to-pump fluid materials, like minerals, ores, sludges, suspensions, slurries for instance drilling muds, but can also be used to pump gels, water and other fluids.

The invention claimed is:

1. A hydraulically driven multicylinder diaphragm pumping machine, the pumping machine comprising a plurality of pump cylinders (10.1-10.12) each having a first end (20) with a first inlet and outlet (21) for fluid to be pumped and a second end (30) with a second inlet and outlet (31,32) for hydraulic fluid, the inlets and outlets being associated with respective valves (23,24;33,34), a separator (40) located inside and movable to-and-fro along the pump cylinder (10), the movable separator (40) having a first side (40*a*) facing the first end (20) of the cylinder and a second side (40*b*) facing the second end (30) of the cylinder, wherein:

the movable separator (40) is connected to the inside (12) of the first end (20) of the cylinder by a first flexible diaphragm (45) in the form of a bellows that is expandable and contractable in concertina-like manner inside the cylinder (10) along the length direction of the cylinder as the movable separator (40) moves to-and-fro along the cylinder, the first side (40*a*) of the movable separator delimiting a first pumping chamber (47) inside the expandable and contractable flexible diaphragm (45) for containing a variable volume of pumped, fluid material in communication with the first inlet and outlet (21) in said first end (20) of the cylinder, said first inlet and outlet (21) communicating with said first chamber (47) whereby in operation fluid material to be pumped enters said first pumping chamber (47) via the first inlet and pumped fluid material leaves said first pumping chamber (47) via the first outlet;

the movable separator (40) is connected to the inside (14) of the second end (30) of the cylinder by a second flexible diaphragm (46) in the form of a bellows that is contractable and expandable in concertina-like manner along the length direction of the cylinder (10) in correspondence with expansion and contraction of the first flexible diaphragm (45), the second side (40*b*) of the movable separator delimiting a second pumping chamber (48) inside the second expandable and contractable diaphragm (46) for containing a variable volume of a pumping hydraulic fluid in communication with the second inlet and outlet (31/32) in said second end (30) of the cylinder, said second inlet and outlet (31,32) communicating with said second pumping chamber (48) whereby in operation pumping hydraulic fluid enters said second pumping chamber (48) via the second inlet (31) and leaves said second pumping chamber (48) via the second outlet (32); and a closed annular non-pumping space (49) is defined between the outside of the first and second diaphragms (45, 46) and the inner wall of the pump cylinder (10), which annular non-pumping space (49) in use contains a non-pumping fluid that is the same as said pumping hydraulic fluid or is different to said pumping hydraulic fluid but has equivalent hydraulic characteristics.

2. The hydraulically driven multicylinder diaphragm pumping machine of claim 1, comprising a sensor for detecting foreign matter in hydraulic fluid in said closed annular non-pumping space (49).

3. The hydraulically driven multicylinder diaphragm pumping machine of claim 1 wherein the first inlet (21) is connected to external means for supplying the material to be pumped under an adjustable pressure sufficient to drive the separators (40) in an intake (return) stroke along the direction from the first end (20) towards the second end (30) of the cylinder (10).

4. The hydraulically driven multicylinder diaphragm pumping machine of claim 3, wherein said means is arranged to supply the material to be pumped under pneumatic pressure.

5. The hydraulically driven multicylinder diaphragm pumping machine of claim 1, comprising means (42, 43, 44) for limiting the length of the stroke of the to-and-fro movement of the movable separator (40) along each cylinder (10).

6. The hydraulically driven multicylinder diaphragm pumping machine of claim 5, wherein the means for limiting the length of the stroke of the movable separator comprises at least one stop member (42, 43) which is carried by and protrudes from the first and/or second side (40*a*, 40*b*) of the movable separator (40) and can come to abut against the inside of the first (20) or second end (30) of the cylinder (10).

7. The hydraulically driven multicylinder diaphragm pumping machine of claim 1, comprising means (51,53) for detecting the position of the movable separator (40) along each cylinder (10), and for controlling the opening and closing of the second inlet and outlet valves (33,34) to produce to-and-fro movement of the movable separators (40) with a controlled stroke length.

8. The hydraulically driven multicylinder diaphragm pumping machine of claim 7, wherein said position detecting means comprises a rod (51) connected for to-and-fro movement with the movable separator (40) and which slidably extends through a bore (52) in the second end (30) of the pump, and means (53) for detecting the position of the rod (51).

9. The hydraulically driven multicylinder diaphragm pumping machine of claim 6, further comprising means for metering the flow of pumping hydraulic fluid leaving the pump cylinders (10) via said outlets (32).

10. The hydraulically driven multicylinder diaphragm pumping machine of claim 9, wherein said position detecting means (21,53) for detecting position and said metering means are associated with a display for showing the positions and the directions of movement of the movable separators (40) in the pump cylinders (10).

11. The hydraulically driven multicylinder diaphragm pumping machine of claim 1, wherein variable volumes of pumping hydraulic fluid in the second pumping chambers (48) of the pump cylinders (10.1-10.12) are connected via the second inlets and outlets (32,33) to a hydraulic circuit (60) external of the cylinders, and wherein the pump contains a given volume of driving hydraulic fluid equal to the sum of the volume of hydraulic fluid in the hydraulic circuit outside the cylinders plus the sum of the volumes of pumping hydraulic fluid in said second pumping chambers (48) of the cylinders, the volume of pumping hydraulic fluid in the individual cylinders (10) varying with the to-and-fro movements of the movable separators (40), while the sum of the volumes of pumping hydraulic fluid in said second pumping chambers (48) of the cylinders (10.1-10.12) remains substantially constant and is substantially equal to ½ the total displacement volume of the cylinders (10.1-10.12) defined as the total volume of hydraulic fluid that is displaceable in each cylinder (10) for the full to-and-fro stroke of each movable member (40) times the number of cylinders.

12. The hydraulically driven multicylinder diaphragm pumping machine of claim 11, comprising a device (65) for adjusting the volume of hydraulic fluid in the hydraulic circuit (60) to compensate for thermal expansion of the hydraulic fluid, which is arranged to maintain the volume of pumping hydraulic fluid in the pump cylinders (10.1-10.12) substantially constant and always substantially equal to ½ the total displacement volume of the cylinders.

13. The hydraulically driven multicylinder diaphragm pumping machine of claim 12, wherein the compensating device (65) comprises a hydraulic fluid cylinder (66) containing a variable volume of hydraulic fluid determined by a movable member (67) applying pneumatic pressure to the hydraulic fluid.

14. The hydraulically driven multicylinder diaphragm pumping machine of claim 1, which is arranged such that in operation the movable separators (40) move with an intake (return) stroke in the direction from the first (20) towards the second end (30) of the cylinders at constant but adjustable speed for all cylinders, and with a pumping stroke in the direction from the second (30) towards the first end (20) of the cylinders at variable speed that is a function of the volume of pumping hydraulic fluid delivered by the cylinders.

15. The hydraulically driven multicylinder diaphragm pumping machine of claim 1, which is arranged such that in use one or a relatively small number of the total number of movable separators (40) is effecting an intake (return) stroke at a relatively high speed while a greater number of movable members (40) are effecting a discharge stroke at a relatively slow speed.

16. A pump cylinder of a hydraulically driven multicylinder pumping machine, the pump cylinder having a first end (20) with a first inlet and outlet (21) for fluid material to be pumped and a second end (30) with a second inlet and outlet (31,32) for pumping hydraulic fluid, the inlets and outlets being associated with respective valves (23,24,25;32,33), a separator (40) located inside and movable to-and-fro along the pump cylinder (10), the movable separator having a first side (40*a*) facing the first end (20) of the cylinder and a second side (40*b*) facing the second end (30) of the cylinder, wherein:

the movable separator (40) is connected to the inside of the first end (20) of the cylinder by a first flexible diaphragm (45) in the form of a bellows that is expandable and contractable in concertina-like manner inside the cylinder (10) along the length direction of the cylinder as the movable separator (40) moves to-and-fro along the cylinder, the first side (40*a*) of the movable separator (40) delimiting a first pumping chamber (47) inside the expandable and contractable flexible diaphragm (45) for containing a variable volume of pumped fluid material in communication with the first inlet and outlet (21) in said first end (20) of the cylinder, said first inlet and outlet (21) communicating with said first pumping chamber (47) whereby in operation fluid material to be pumped enters said first pumping chamber (47) via the first inlet and pumped fluid material leaves said first pumping chamber (47) via the first outlet;

the movable separator (40) is connected to the inside of the second end (10) of the cylinder by a second flexible diaphragm (46) in the form of a bellows that is contractable and expandable in concertina-like manner along the length direction of the cylinder in correspondence with expansion and contraction of the first flexible diaphragm, the second side (40*b*) of the movable separator (40) delimiting a second pumping chamber (48) for containing a variable volume of a pumping hydraulic fluid in communication with the second inlet and outlet (32,33) in said second end (30) of the cylinder, said second inlet and outlet (31,32) communicating with said second pumping chamber (48) whereby in operation pumping hydraulic fluid enters said second pumping chamber (48) via the second inlet (31) and leaves said second pumping chamber (48) via the second outlet (32); and a closed annular non-pumping space (49) is defined between the outside of the first and second diaphragms (47, 46) and the inner wall of the pump cylinder which annular non-pumping space (49) in use contains a non-pumping fluid that is the same as said pumping hydraulic fluid or is different to said pumping hydraulic fluid but has equivalent hydraulic characteristics to said hydraulic fluid.

17. A method of operating a hydraulically driven multicylinder pumping machine comprising a plurality of pump cylinders (10.1-10.12) each having a first end (20) with a first inlet and outlet (21) for fluid to be pumped and a second end (30) with a second inlet and outlet (31, 32) for hydraulic fluid, the inlets and outlets being associated with respective valves (23, 24; 33, 34), a separator (40) located inside and movable to-and-fro along the pump cylinder (10), the movable separator (40) having a first side (40*a*) facing the first end (20) of the cylinder and a second side (40*b*) facing the second end (30) of the cylinder, wherein:

the movable separator (40) is connected to the inside (12) of the first end (20) of the cylinder by a first flexible diaphragm (45) in the form of a bellows that is expandable and contractable in concertina-like manner inside the cylinder (10) along the length direction of the cylinder as the movable separator (40) moves to-and-fro along the cylinder, the first side (40*a*) of the movable separator delimiting a first pumping chamber (47) inside the expandable and contractable flexible diaphragm (45) for containing a variable volume of pumped fluid material in communication with the first inlet and outlet (21) in said first end (20) of the cylinder, said first inlet and outlet (21) communicating with said first chamber (47) whereby in operation fluid material to be pumped enters said first pumping chamber (47) via the first inlet and pumped fluid material leaves said first pumping chamber (47) via the first outlet;

the movable separator (40) is connected to the inside (14) of the second end (30) of the cylinder by a second flexible diaphragm (46) in the form of a bellows that is contractable and expandable in concertina-like manner along the length direction of the cylinder (10) in correspondence with expansion and contraction of the first flexible diaphragm (45), the second side (40*b*) of the movable separator delimiting a second pumping chamber (48) inside the second expandable and contractable diaphragm (46) for containing a variable volume of a pumping hydraulic fluid in communication with the second inlet and outlet (31/32) in said second end (30) of the cylinder, said second inlet and outlet (31, 321 communicating with said second pumping chamber (48) whereby in operation pumping hydraulic fluid enters said second pumping chamber (48) via the second inlet (31) and leaves said second pumping chamber (48) via the second outlet (32); and a closed annular non-pumping space (49) is defined between the outside of the first and second diaphragms (45, 46) and the inner wall of the pump cylinder (10), which annular non-pumping space (49) in use contains a non-pumping fluid that is the same as said pumping hydraulic fluid or is different to said pumping hydraulic fluid but has equivalent hydraulic characteristics, wherein the first inlets and outlets (21) communicate the first pumping chambers (47) with a fluid material to be pumped under pressure, and the second inlets and outlets (31,32) communicate the second pumping chambers (48) with a pumping hydraulic fluid, the method comprising:

driving the movable separators (40) of a first sub-group of cylinders with an intake (return) stroke along the direction from the first end (30) towards the second end (30) of the cylinder (10) to intake pressurized fluid material to be pumped into the first pumping chambers (47), and simultaneously discharge pumping hydraulic fluid from the corresponding second pumping chambers (48), while driving the movable separators (40) of a second sub-group of cylinders, that corresponds to the remaining cylinders of said plurality of cylinders, with a pumping stroke along the direction from the second end (20) towards the first end (20) of the cylinder (10) by intaking pressurized pumping hydraulic fluid into the corresponding second pumping chambers (48) to discharge pumped fluid material from the first pumping chambers (47), and maintaining the sum of the volumes of pumping hydraulic fluid in said second chambers (48) of the cylinders substantially constant and substantially equal to ½ the total displacement volume of the cylinders (48) defined as the total volume of hydraulic fluid that is displaceable in each cylinder (10) for the full to-and-fro stroke of each movable separator (40) times the number of cylinders.

18. The method of claim 17, wherein the movable separators (40) move all with an intake stroke at constant speed, and with pumping strokes at variable speeds that are a function of the volume of the pumping hydraulic fluid delivered to the cylinders.

19. The method of claim 17, wherein one or a relatively small number of the total number of movable separators (40) is effecting an intake (return) stroke at a relatively high speed while a greater number of movable separators (40) are effecting a discharge stroke at relatively slow speed.

20. The method of claim 17 which comprises starting up the hydraulically driven multicylinder pumping machine according to the following procedure:

filling the pump cylinders (10) with different volumes of hydraulic oil so that the pump cylinders (10.1-10.12) contain in total a volume of hydraulic oil equal to ½ the total displacement volume of the cylinders (10.1-10.12);

placing the movable separators (40) in to-and-fro motion while maintaining the same total volume of pumping hydraulic fluid in the cylinders (10.1-10.12).

* * * * *